US005719379A

United States Patent [19]

Huang et al.

[11] Patent Number: 5,719,379

[45] Date of Patent: Feb. 17, 1998

[54] POWER CONTROL DEVICE FOR A PRESSING IRON USING OPTICAL SENSING AND CONTROL

[75] Inventors: Wen-Lung Huang, Tainan; Chien-Bang Chion, Tainan Hsien, both of Taiwan

[73] Assignee: Ever Splendor Enterprise Co., Ltd., Tainan, Taiwan

[21] Appl. No.: 705,518

[22] Filed: Aug. 29, 1996

[51] Int. Cl.[6] ..... H05B 1/02

[52] U.S. Cl. ..... 219/502; 219/497; 219/252; 219/505; 219/518

[58] Field of Search ..... 219/250–252, 219/497, 501, 502, 508, 518, 505; 307/117, 119

[56] References Cited

U.S. PATENT DOCUMENTS

| | | | |
|---|---|---|---|
| 4,859,869 | 8/1989 | Heuwinkel et al. | 307/117 |
| 5,380,983 | 1/1995 | Cavada et al. | 219/250 |
| 5,463,205 | 10/1995 | Sham et al. | 219/502 |

*Primary Examiner*—Mark H. Paschall

*Attorney, Agent, or Firm*—Christensen, O'Connor, Johnson & Kindness PLLC

[57] ABSTRACT

A power control device is to be used with a pressing iron which includes a soleplate, a housing mounted on the soleplate and provided with a handle, a heating device disposed in the housing and operable so as to heat the soleplate, and a power supplying unit for supplying electric power to the heating device. The power control device includes a switch circuit adapted to connect electrically the heating device and the power supplying unit, an optical sensor unit adapted to be mounted on the handle of the housing, the optical sensor unit generating a first control signal when the handle is released and a second control signal when the handle is gripped, and a timer circuit connected electrically to the switch circuit and the optical sensor unit. The timer circuit receives the first and second control signals from the optical sensor unit and deactivates the switch circuit so as to disconnect the heating device from the power supplying unit upon detection that the handle was continuously released within a predetermined first time period. The timer circuit further deactivates the switch circuit upon detection that the handle was continuously gripped within a predetermined second time period.

13 Claims, 2 Drawing Sheets

POWER CONTROL DEVICE FOR A PRESSING IRON USING OPTICAL SENSING AND CONTROL

BACKGROUND OF THE INVENTION

1. Field of the Invention

The invention relates to a pressing iron, more particularly to a power control device for a pressing iron which can automatically interrupt power to a heating element of the iron upon detection that the iron has been left unattended.

2. Description of the Related Art

It is well known in the art for pressing irons to incorporate a temperature-controlled switch for maintaining the temperature of a soleplate of the iron to be within a predetermined temperature range. When a power supplying unit of the iron is activated, the temperature-controlled switch permits the supply of electric power to a heating element of the iron until the soleplate temperature reaches an upper limit of the temperature range. At this time, the temperature-controlled switch interrupts the supply of power to the heating element until the soleplate temperature reaches a lower limit of the temperature range. Power is then restored to the heating element.

It is not uncommon for a person using the conventional pressing iron to be distracted while the iron is activated. This may lead to scorching of the fabric being ironed and to the occurrence of a fire. In addition, electric power is wasted since the heating element is intermittently activated in order to maintain the soleplate temperature within the predetermined temperature range even when the iron is left unattended.

In U.S. Pat. No. 4,686,352, there is disclosed a pressing iron having a mercury switch which serves as a motion and attitude sensor and which is connected to a timer. The mercury switch operates in conjunction with the timer to disable a heating element of the iron when the iron is oriented with its soleplate substantially horizontal and not moving, and when the iron is oriented with its soleplate substantially vertical after passage of a predetermined time period. Although such features can overcome the drawbacks mentioned beforehand, the mercury switch used in the aforementioned patent can be a source of environmental pollution and is expensive, thereby resulting in a higher product cost.

SUMMARY OF THE INVENTION

Therefore, the object of this invention is to provide a power control device for a pressing iron which does not use a mercury switch to automatically interrupt power to a heating element of the iron upon detection that the iron has been left unattended.

More specifically, the object of this invention is to provide a power control device for a pressing iron which employs an optical sensor unit that determines whether the iron is left unattended and that operates in conjunction with a timer circuit and a switch circuit to disable a heating element of the iron when a handle of a housing of the iron was continuously released within a predetermined first time period or when the handle was continuously gripped within a predetermined second time period.

Accordingly, the power control device of this invention is to be used with a pressing iron which includes a soleplate, a housing mounted on the soleplate and provided with a handle, a heating device disposed in the housing and operable so as to heat the soleplate, and a power supplying unit for supplying electric power to the heating device. The power control device includes a switch circuit adapted to connect electrically the heating device and the power supplying unit, an optical sensor unit adapted to be mounted on the handle of the housing, the optical sensor unit generating a first control signal when the handle is released and a second control signal when the handle is gripped, and a timer circuit connected electrically to the switch circuit and the optical sensor unit. The timer circuit receives the first and second control signals from the optical sensor unit and deactivates the switch circuit so as to disconnect the heating device from the power supplying unit upon detection that the handle was continuously released within a predetermined first time period. The timer circuit further deactivates the switch circuit upon detection that the handle was continuously gripped within a predetermined second time period.

BRIEF DESCRIPTION OF THE DRAWINGS

Other features and advantages of this invention will become apparent in the following detailed description of the preferred embodiment with reference to the accompanying drawings, of which.

DETAILED DESCRIPTION OF THE PREFERRED EMBODIMENT

Figure 1:
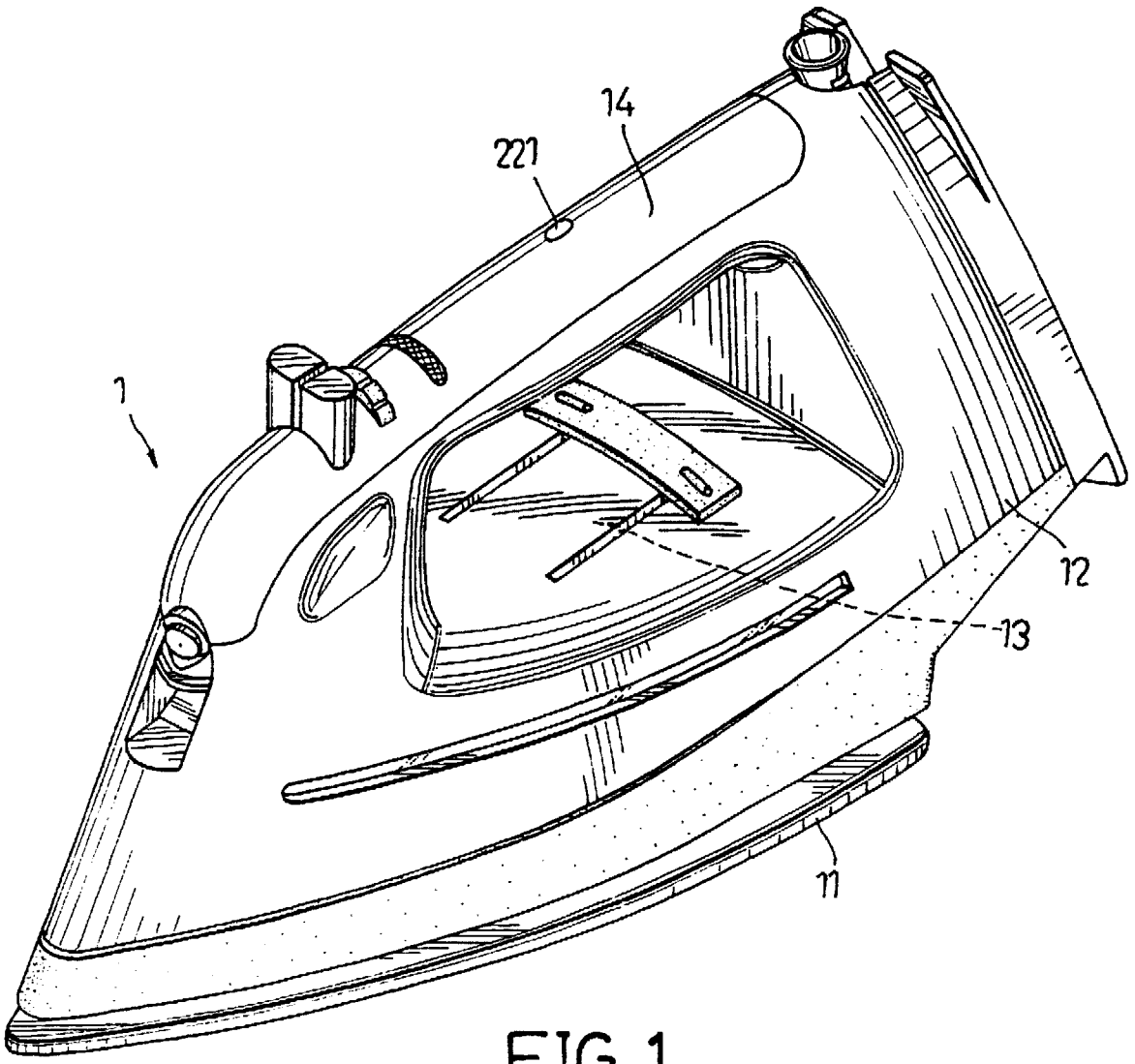
FIG. 1 is a perspective view of a pressing iron which incorporates the preferred embodiment of a power control device according to this invention.
Figure 2:
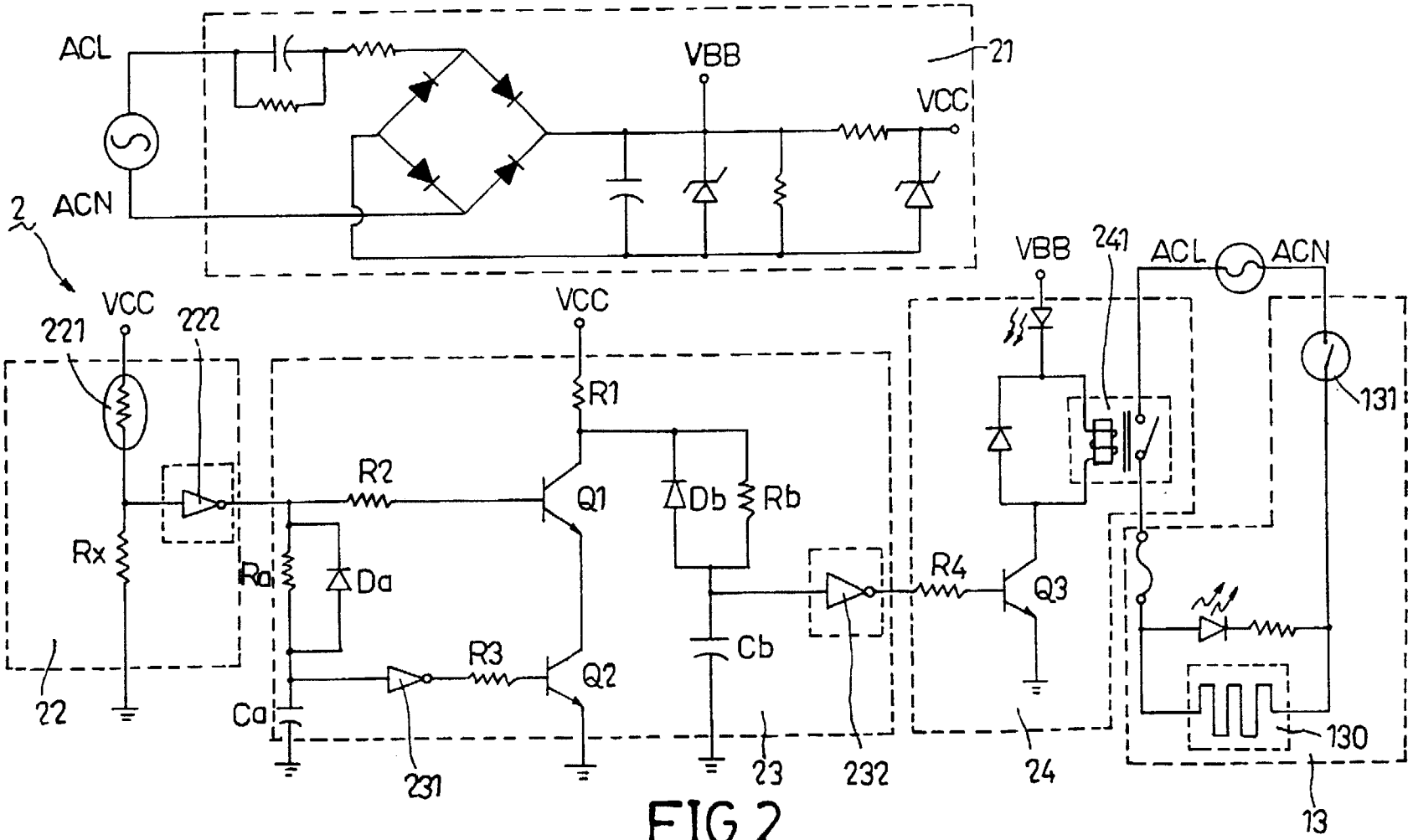
FIG. 2 is a schematic electrical circuit diagram of the preferred embodiment.

FIG. 1 illustrates a pressing iron 1 which incorporates the preferred embodiment of a power control device according to this invention. The pressing iron 1 has a soleplate 11, a housing 12 mounted on the soleplate 11, and a heating device 13 mounted in the housing 12 for heating the soleplate 11. The housing 12 has a handle 14 for gripping the iron 1. Referring to FIG. 2, the heating device 13 includes a heating element 130 which is in good heat conducting relationship with the soleplate 11, and a temperature-controlled switch 131 which interconnects the heating element 130 to a power supplying unit 21 of the iron 1 in order to maintain the temperature of the soleplate 11 to within a predetermined temperature range as is known in the art. The power control device 2 includes an optical sensor unit 22, a timer circuit 23 and a switch circuit 24 which connects electrically the power supplying unit 21 and the heating device 13.

The optical sensor unit 22 includes a conventional metal-sulfide light sensitive resistor 221 to be mounted on the handle 14 of the housing 12, a resistor Rx in series with the resistor 221, and an inverter 222 having an input end connected to a junction of the resistors 221, Rx. The resistors 221, Rx are connected across a Vcc terminal of the power supplying unit 21 and a ground terminal. When the iron 1 is not in use, the handle 14 is not gripped, thereby exposing the resistor 221 to light. The resistance of the resistor 221 is smaller than that of the resistor Rx at this time, thereby generating a high logic input signal at the input of the inverter 222. The output of the inverter 222 is a low-logic first control signal at this time. However, when the user grips the handle 14, the resistor 221 is concealed from light. The resistance of the resistor 221 becomes greater than that of the resistor Rx, thereby generating a low logic input signal at the input of the inverter 222. The output of the inverter 222 is a high-logic second control signal at this time.

The timer circuit 23 is connected to the output of the inverter 222 and includes first and second slow-charging, fast-discharging circuits constituted by a resistor Ra, Rb, a capacitor Ca, Cb in series with the resistor Ra, Rb, and a diode Da, Db connected across the resistor Ra, Rb. Charging of the capacitor Ca, Cb is accomplished via the resistor Ra, Rb. Discharging of the capacitor Ca, Cb, however, is accomplished via the diode Da, Db, thereby resulting in a discharge time which is shorter than the charging time. The timer circuit 23 further includes two inverters 231, 232, first and second transistors Q1, Q2, and first, second and third current limiting resistors R1, R2, R3. Each of the inverters 231, 232 has an input terminal connected to a junction of the resistor Ra, Rb and the capacitor Ca, Cb of a respective one of the charge-discharge circuits. The first transistor Q1 has a collector terminal connected to the Vcc terminal of the power supplying unit 21 via the first current limiting resistor R1 and is further connected to the resistor Rb of the second charge-discharge circuit. The base terminal of the first transistor Q1 is connected to the output of the inverter 222 via the second current limiting resistor R2. The emitter terminal of the first transistor Q1 is connected to the collector terminal of the second transistor Q2. The emitter terminal of the second transistor Q2 is grounded. The base terminal of the second transistor Q2 is connected to the output of the inverter 231 via the third current limiting resistor R3.

The switch circuit 24 includes a third transistor Q3, a fourth current limiting resistor R4 which connects a base terminal of the third transistor Q3 to the output of the inverter 232, and a relay 241 which has a coil portion for connecting the collector terminal of the third transistor Q3 to a VBB terminal of the power supplying unit 21, and a contact portion for connecting the heating device 13 to the power supplying unit 21.

The operation of the preferred embodiment will now be described in the following paragraphs:

When the power supplying unit 21 is activated, the optical sensor unit 22 generates one of the first and second control signals which is received by the timer circuit 23. When the handle 14 is released, the resistor 221 is exposed to light, thereby causing the resistance of the resistor 221 to be smaller than that of the resistor Rx. A high logic input signal is generated at the input of the inverter 222, and the inverter 222 outputs the low-logic first control signal. The capacitor Ca is quickly discharged via the diode Da, and the first transistor Q1 is turned off, thereby charging the capacitor Cb. Since the capacitor Cb is initially in a fully discharged state, the inverter 232 initially has a low logic input, thereby causing the inverter 232 to generate a high logic output. The high logic output of the inverter 232 drives the third transistor Q3 to conduct, thereby permitting electric current to flow through the coil portion of the relay 241 so as to energize the same. When the relay 241 is energized, the contact portion of the relay 241 connects the heating device 13 to the power supplying unit 21 so as to activate the heating device 13. Once the capacitor Cb is fully charged, the inverter 232 has a high logic input, thereby causing the inverter 232 to generate a low logic output. The third transistor Q3 ceases to conduct, thereby deactivating the relay 241. The relay 241 ceases to connect the heating device 13 to the power supplying unit 21 so as to deactivate the heating device 13. In this embodiment, the time required for charging the capacitor Cb is about two minutes. Thus, the iron 1 is automatically deactivated when the handle 14 was continuously released by the user for a predetermined first time period of about two minutes.

When the user grips the handle 14, the resistor 221 is concealed from light, thereby causing the resistance of the resistor 221 to become greater than that of the resistor Rx. A low logic input signal is generated at the input of the inverter 222, and the inverter 222 generates the high-logic second control signal. Since the capacitor Ca is initially in a fully discharged state, the inverter 231 has a low logic input and generates a high logic output. Since the base terminals of the first and second transistors Q1, Q2 receive the high logic outputs from the inverters 222, 231, respectively, the first and second transistors Q1, Q2 conduct, thereby resulting in a low logic signal at the collector of the first transistor Q1. The capacitor Cb is quickly discharged via the diode Db, and the inverter 232 has a low logic input, thereby causing the inverter 232 to generate the high logic output which drives the third transistor Q3 to conduct in order to energize the relay 241 and permit activation of the heating device 13. Once the capacitor Ca is fully charged, the inverter 232 has a low logic input, thereby causing the inverter 232 to generate a high logic output. The second transistor Q2 is turned off, thereby turning off the first transistor Q1. Charging of the capacitor Cb is then commenced. Since the capacitor Cb is initially in a fully discharged state, the inverter 232 generates the high logic output for driving the third transistor Q3 to conduct so as to continue energizing of the relay 241 and the supply of electric current to the heating device 13 until the capacitor Cb is fully charged. Thus, when the handle 14 is continuously gripped by the user, the timer circuit 23 permits continuous activation of the heating device 13 up to a predetermined second time period equal to the total time required for charging the capacitors Ca, Cb of the charge-discharge circuits. In this embodiment, the time required for charging the capacitor Ca is also set to about two minutes. Thus, the predetermined second time period is about four minutes.

When the handle 14 is released by the user before the second time period expires, the timer circuit 23 permits continued activation of the heating device 13 for the first time period if the handle 14 remains released. Otherwise, the timer circuit 23 permits continued activation of the heating device 13 for the second time period starting from the time the handle 14 is once again gripped by the user.

It has thus been shown that the power control device 2 automatically disables the heating device 13 of the iron 1 upon detection that the handle 14 was continuously released within the first time period. The power control device 2 also disables the heating device 13 upon detection that the handle 14 was continuously gripped during the second time period, meaning that the user is in a distracted state since the handle 14 should be frequently gripped and released by the user for short amounts of time when the iron 1 is in use. Thus, the heating device 13 remains activated as long as the handle 14 does not remain released for the first time period and as long as the handle 14 does not remain gripped for the second time period. Once deactivated, the heating device 13 is again activated upon detection of a change in the handle 14 from a gripped state to a released state or vice versa.

Since the heating device 1 is deactivated when the iron 1 is left unattended, scorching of the fabric being ironed can be avoided and the risk of a fire can be effectively minimized. In addition, electric power is not wasted since the soleplate temperature is not maintained to within a predetermined temperature range when the iron 1 is unattended. Moreover, since the power control device 2 employs an optical sensor unit 22 instead of a mercury switch to detect whether the iron 1 is unattended, the power control device 2 is more environmental friendly and is less expensive to manufacture. The objects of this invention are thus met.

While this invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

We claim:

1. A power control device for a pressing iron, the pressing iron including a soleplate, a housing mounted on the soleplate and provided with a handle, a heating device disposed in the housing and operable so as to heat the soleplate, and a power supplying unit for supplying electric power to the heating device, said power control device comprising:

a switch circuit adapted to connect electrically the heating device and the power supplying unit;

an optical sensor unit adapted to be mounted on the handle of the housing, said optical sensor unit generating a first control signal when the handle is released and a second control signal when the handle is gripped; and a timer circuit connected electrically to said switch circuit and said optical sensor unit, said timer circuit receiving the first and second control signals from said optical sensor unit and deactivating said switch circuit so as to disconnect the heating device from the power supplying unit upon detection that the handle was continuously released within a predetermined first time period, wherein said timer circuit further deactivates said switch circuit upon detection that the handle was continuously gripped within a predetermined second time period.

2. The power control device as claimed in claim 1, wherein said timer circuit further deactivates said switch circuit upon detection that the handle was continuously gripped within a predetermined second time period.

3. The power control device as claimed in claim 1, wherein said optical sensor unit comprises a light sensitive resistor.

4. The power control device as claimed in claim 1, wherein the first time period is about two minutes.

5. The power control device as claimed in claim 1, wherein said timer circuit comprises a first charge-discharge circuit having a charging time equal to the first time period, and a second charge-discharge circuit having a charging time equal to difference between the first and second time periods, charging of said second charge-discharge circuit starting only after said first charge-discharge circuit has been fully charged.

6. The power control device as claimed in claim 1, wherein the second time period is about four minutes.

7. A pressing iron compromising a soleplate, a housing mounted on said soleplate and provided with a handle, a heating device disposed in said housing and operable so as to heat said soleplate, a power supplying unit for supplying electric power to said heating device, and a power control device which includes:

a switch circuit connected electrically to said heating device and said power supplying unit;

an optical sensor unit mounted on said handle of said housing, said optical sensor unit generating a first control signal when said handle is released and a second control signal when said handle is gripped; and a timer circuit connected electrically to said switch circuit and said optical sensor unit, said timer circuit receiving the first and second control signals from said optical sensor unit and deactivating said switch circuit so as to disconnect said heating device from said power supplying unit upon detection that said handle was continuously released within a predetermined first time period, wherein said timer circuit further deactivates said switch circuit upon detection that said handle was continuously gripped within a predetermined second time period.

8. The pressing iron as claimed in claim 7, wherein said optical sensor unit comprises a light sensitive resistor.

9. The pressing iron as claimed in claim 7, wherein the first time period is about two minutes.

10. The pressing iron as claimed in claim 7, wherein said timer circuit comprises a charge-discharge circuit having a charging time equal to the first time period.

11. The pressing iron as claimed in claim 7, wherein said timer circuit comprises a first charge-discharge circuit having a charging time equal to the first time period, and a second charge-discharge circuit having a charging time equal to difference between the first and second time periods, charging of said second charge-discharge circuit starting only after said first charge-discharge circuit has been fully charged.

12. The pressing iron as claimed in claim 7, wherein the second time period is about four minutes.

13. The pressing iron as claimed in claim 7, wherein said heating device comprises a heating element which is in good heat conducting relationship with said soleplate, and a temperature-controlled switch which interconnects said heating element and said power supplying unit in order to maintain temperature of said soleplate to within a predetermined temperature range.

* * * * *

UNITED STATES PATENT AND TRADEMARK OFFICE

CERTIFICATE OF CORRECTION

PATENT NO. : 5,719,379

DATED : February 17, 1998

INVENTOR(S) : W.-L. Huang et al.

It is certified that error appears in the above-identified patent and that said Letters Patent is hereby corrected as shown below:

| COLUMN | LINE | |
|---|---|---|
| [73] | Assignee | "Enterprise" should read --Enterprises-- |
| [56] | Refs. Cited (U.S. Pat. Docs.) | Please insert the following reference: --4,686,352 8/1987 Nawrot et al.-- |
| 5 (Claim 2, | 33-36 lines 1-4) | Replace the text of Claim 2 with the following text: --The power control device as claimed in Claim 1, wherein said timer circuit comprises a charge-discharge circuit having a charging time equal to the first time period.-- |
| 5 (Claim 5, | 46 line 5) | Before "difference" insert --the-- |
| 6 (Claim 7, | 1 line 1) | "compromising" should read --comprising-- |

UNITED STATES PATENT AND TRADEMARK OFFICE

CERTIFICATE OF CORRECTION

PATENT NO. : 5,719,379

DATED : February 17, 1998

INVENTOR(S) : W.-L. Huang et al.

It is certified that error appears in the above-identified patent and that said Letters Patent is hereby corrected as shown below:

| COLUMN | LINE | |
|---|---|---|
| 6 (Claim 11, line 5) | 37 | Before "difference" insert --the-- |

Signed and Sealed this

Fourteenth Day of July, 1998

Bruce Lehman

*Attest:*

BRUCE LEHMAN

*Attesting Officer*

*Commissioner of Patents and Trademarks*